US010307658B2

(12) United States Patent
Vece et al.

(10) Patent No.: US 10,307,658 B2
(45) Date of Patent: Jun. 4, 2019

(54) MOUTH GUARD

(71) Applicants: Nicholas C. Vece, Katonah, NY (US); Lucia S. Vece, Katonah, NY (US)

(72) Inventors: Nicholas C. Vece, Katonah, NY (US); Lucia S. Vece, Katonah, NY (US)

( * ) Notice: Subject to any disclaimer, the term of this patent is extended or adjusted under 35 U.S.C. 154(b) by 691 days.

(21) Appl. No.: 14/938,487

(22) Filed: Nov. 11, 2015

(65) Prior Publication Data

US 2017/0007906 A1 Jan. 12, 2017

Related U.S. Application Data

(60) Provisional application No. 62/190,847, filed on Jul. 10, 2015.

(51) Int. Cl.
*A63B 71/08* (2006.01)

(52) U.S. Cl.
CPC ..... *A63B 71/085* (2013.01)

(58) Field of Classification Search
CPC ..... A61F 5/566; A61F 5/56; A61F 2005/563; A61F 5/58; A61C 7/08; A61C 19/063; A61B 5/4547; A61B 5/4552; A61B 5/4557; A61B 5/682; A61B 5/0534; A63B 71/085; A63B 2071/086; A63B 2017/088
See application file for complete search history.

(56) References Cited

U.S. PATENT DOCUMENTS

| | | | | |
|---|---|---|---|---|
| 3,505,995 | A * | 4/1970 | Greenberg | A63B 71/085 128/862 |
| 4,761,136 | A | 8/1988 | Madhavan et al. | |
| 5,733,118 | A * | 3/1998 | Pankuch | A61C 9/0006 433/37 |
| 8,100,131 | B2 | 1/2012 | Swann et al. | |
| 2012/0017922 | A1* | 1/2012 | Hirshberg | A63B 71/085 128/861 |
| 2012/0231932 | A1* | 9/2012 | Rafih | A63B 71/085 482/11 |

OTHER PUBLICATIONS

Aproshield, GPA Supporting Players Mouthguard Information Booklet, pp. 1-3.
Dick's Sporting Goods, Zone Adult Custom Mouthguard Kit, http://www.dickssportinggods.com/product/index, pp. 1-3.

* cited by examiner

*Primary Examiner* — Tarla R Patel
(74) *Attorney, Agent, or Firm* — Gottlieb, Rackman & Reisman, P.C.

(57) ABSTRACT

A mouth guard that can be customized in the field without needing to boil the mouth guard is disclosed. The mouth guard comprises a facial and lingual walls mounted on a thin flexible tray, such as a fabric mesh. Stops are positioned on the tray to space the user's teeth away from the tray. A layer of uncured elastomeric impression material is applied to the tray and the user bites down on the mouth guard to custom fit the mouth guard to the shape of the user's upper and lower teeth. The facial wall can be made of separate spaced-apart walls that can also be filled with impression or impact absorbing material.

23 Claims, 10 Drawing Sheets

MOUTH GUARD

CROSS-REFERENCE TO RELATED APPLICATIONS

This application claims priority to U.S. Provisional Application No. 62/190,847, filed Jul. 10, 2015, the entire contents of which is expressly incorporated by reference.

FIELD OF THE INVENTION

This invention relates to a mouth guard that can be easily be custom fitted on-demand.

BACKGROUND

Many sporting events require that participants wear a mouth guard in order to protect their teeth from damage in case of an impact. There are a wide variety of mouth guard types that can be used. Inexpensive "stock" mouth guards come in pre-set sizes and shapes and may not fit to the particular shape of a user's mouth. They may also not fit snugly around the teeth, making it more likely that the mouthpiece will fall out.

More sophisticated mouth guards include plastics which soften when boiled. These mouth guards can be custom fitted by boiling them to soften the plastic, after which a user can place the mouth guard in their mouth and bite while the plastic is still soft to deform it and create a custom fit. Another further way to manufacture customized mouth guards is to custom manufacture the mouth guard from a separate impression of the wearer's teeth. This requires that an impression be taken and sent to a manufacturing facility. The mouth guard is then custom formed based on the impression and returned to the user.

One particular problem that occurs frequently at sporting events where mouth guards must be worn is that participants forget or lose their mouth guard. If they do not have a replacement mouth guard, they may be prevented from participating in the sport. To avoid this situation, coaches frequently have available a selection of stock mouth guards that can be used. However, these mouth guards cannot be custom fitted to the user at the venue. Even if the stock mouth guards can be customized after a boiling process, it is typically not feasible to boil a mouth guard at the sporting venue.

Accordingly, a need exists for a mouth guard which can be easily and quickly custom fitted to a user's teeth on demand at a sporting event without the need for boiling the mouth guard to soften its material.

It is known to provide a mouth guard tray blank along with a two-part putty that can be mixed by a user, applied to the tray of the mouth guard between its facial and lingual walls and then used to take an impression of the wearer's upper teeth.

A drawback to this design is that the user may bite hard enough on the tray during the impression process to displace enough of the impression material that little or no impression material remains between the upper and lower teeth. This compromises both the fit and the degree of protection of the completed mouth guard. A further drawback is that if the mouth guard is too small or positioned incorrectly when the impression is taken, the user's teeth may be so close to, or even touching the facial wall, that there no impression material will fill this area daring the fitting. As a result, the only side impact protection provided to teeth in such regions comes from the facial wall itself. While the facial wall could be made thicker, this also reduces the ability of the mouth guard to mold to the particular shape of a user's mouth during the fitting process. There exists a need to provide an improved mouth guard that addresses these issues as well.

SUMMARY

These and other needs are met by a mouth guard that has an outer U-shaped facial wall mounted on a thin flexible tray. An inner U-shaped inner lingual wall is also mounted on the tray. The facial and lingual walls wrap around the teeth of the upper dental arch. One or more stops are positioned on the surface of the tray so that when the user bites the mouth guard, the biting surfaces of upper teeth adjacent the stops (such as the incisors and molars) are spaced apart from the surface of the tray. To custom fit the mouth guard, a layer of elastomeric impression material is applied to the tray. The user then bites down on the mouth guard and holds the bite until the impression material has sufficiently set for the mouth guard to be removed while retaining the impression.

The tray material is preferably thin and flexible enough so that it can take the impression of the lower teeth as they bite onto a tray with uncured impression material on it. The tray can have holes in it sufficiently large for the impression material to flow through the holes when biting pressure is applied to the uncured impression material. The tray can be formed of the same material as the walls of the mouth guard and the stops so that these components can be integrally formed. Alternatively, the tray can be a fabric mesh on which the walls and stops of a different material are mounted.

In a preferred configuration, the facial wall is formed of an inner and outer wall that are a few millimeters apart from each other. This spacing provides for a facial wall of the mouth guard that is sufficiently thick to protect the teeth even if the user fits the mouth guard with their teeth right up against the innermost surface of facial wall and without requiring that the entire thickness of the facial wall be formed of the plastic wall material itself. The gap in the double facial wall parts can be left open, filled with impression material during the custom fitting process, or can be pre-filled with an impact absorbing gel material. It can also be sealed during manufacturing to form a gas-filled pneumatic cushion.

A custom mouth guard kit can be provided which combines the pre-formed mouth guard parts (e.g., the facial wall, tray, and stops), and a volume of uncured impression material. The impression material is packaged in a way to ensure that it remains uncured until needed, whether by being provided in the form of a two-part putty that does not set until mix, or in a pre-mixed form that is supplied in an air-tight and/or light-tight package and which can be in a separate package and applied by the user when needed or pre-applied to the tray of the mouth guard so that the unit is pre-prepared to take an impression.

Coaches or players at a sporting event can have a selection of mouth guard kits available so that they can quickly and easily make a custom fitted mouth guard on-demand at the venue and without having to boil the mouth guard to soften the material.

In addition, the custom-mouth guard kit can include an appropriately sized plastic case that is impregnated with a disinfectant, such as Listerine™ or other conventional disinfectants such as chlorhexidine.

DETAILED DESCRIPTION OF PREFERRED EMBODIMENTS

Figure 1:
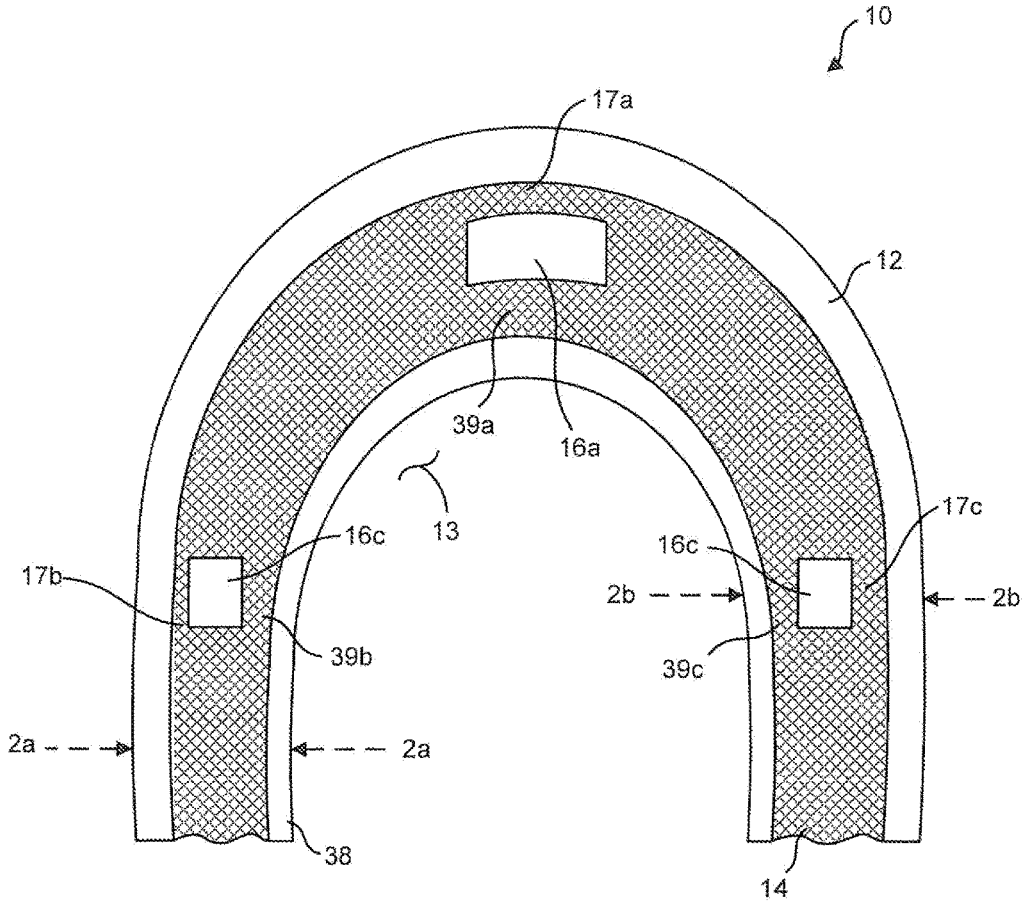
FIG. 1 is a top view of a first embodiment of a mouth guard according to aspects of the invention.
Figure 2A:
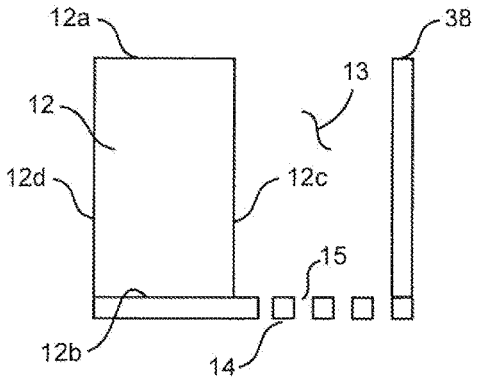
FIGS. 2A and 2B are a cross-sectional views along the line 2*a*-2*a* and 2*b*-2*b* of FIG. 1.
Figure 2B:
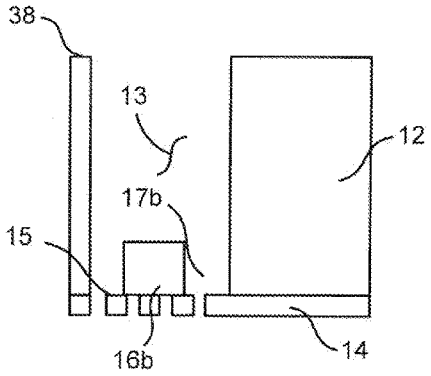

Turning to FIG. 1 and FIGS. 2A and 2B there is shown a top view of a first embodiment of a mouth guard 10 according to various aspects of the invention. The mouth guard 10 is comprised of a facial wall 12 and a tray 14. The facial wall 12 is generally U-shaped to match the general shape of a person's upper dental arch and defines an interior space 13. The facial wall has a top 12*a*, a bottom 12*b*, an inner surface 12*c*, and an outer surface 12*d*. Facial wall 12 may be formed of plastic or other conventional materials. Facial wall 12 is sized so that when the mouth guard 10 is worn, the facial wall 12 covers facial surfaces of at least some of the upper teeth of a person wearing the mouth guard. Preferably the facial wall 12 covers at least a person's upper incisors, upper canines, and upper pre-molars.

Extending inward into the interior space 13 from the bottom 12*b* of facial wall 12 is a generally flat thin and flexible tray 14. Tray 14 and extends into the interior space 13 a sufficient distance to extend generally past the biting surfaces of the upper teeth that would be covered by the mouth guard when worn and is also preferably generally U-shaped.

The mouth guard further has an inner lingual wall 38 on the tray 14. Lingual wall 38 is also generally U-shaped and defines an inner boundary of the interior space 13 creating a gap wide enough for the user's teeth to fit into when the mouth guard is worn.

The tray 14 is preferably formed of a textured mesh material that most preferably has numerous openings, such as vias or holes 15, running from the top to the bottom surfaces of the tray in at least the areas which are not covered by the facial and lingual walls 12, 38 at and that are sufficiently large to permit impression material to flow into and/or through then as discussed further below. The tray 14 does not need to be comprised of the same material as the facial wall 12. In a preferred embodiment, the tray is comprised of a flexible thin plastic fabric-like mesh on which the facial wall 12 and lingual wall 38 are mounted, such as shown in FIGS. 2A and 2B.

Figure 2C:
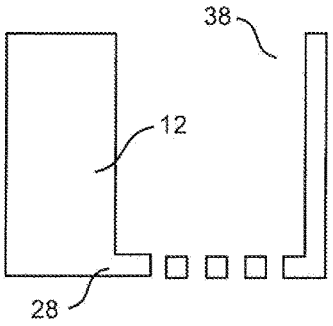
FIGS. 2C and 2D are alternative embodiments of FIGS. 2A and 2B.
Figure 2D:
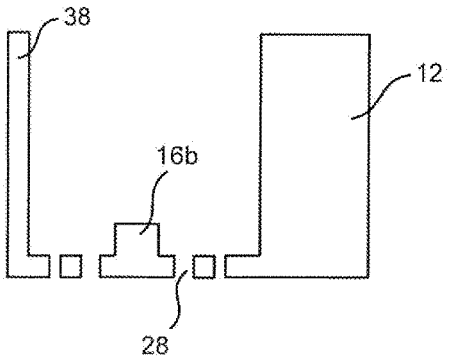

The facial and lingual walls 12, 38 can be made of the same material as each other. Further, facial and lingual walls 12, 38 may be made of the same material as the tray 14 and all three components integrally formed, such as shown in FIGS. 2C and 2D.

In addition, and as shown in FIGS. 1 and 2B, mouth guard 10 has one or more stops 16 on the tray 14 which extend above the surface of the tray and are preferably at least twice the thickness of the tray. The stops are positioned and sized so that at least part of the top surface of the stop will be generally adjacent the biting surfaces of one or more upper teeth when the mouth guard is worn. When the wearer bites down on the mouth guard, the stops preserve a gap between the upper teeth and the tray. Preferably there are at least three stops, one of which is generally adjacent a wearer's incisors while stops the other two are on the left and right sides generally adjacent the wearer's molars or pre-molars such as stops 16*a*, 16*b*, and 16*c* shown in FIG. 1.

As with the facial wall, the stops can be discrete components affixed to the tray as shown in FIG. 2B. Alternatively, the stops can be made of the same material as the tray 14 and integrally formed with the tray as shown in FIG. 2D.

Figure 10:
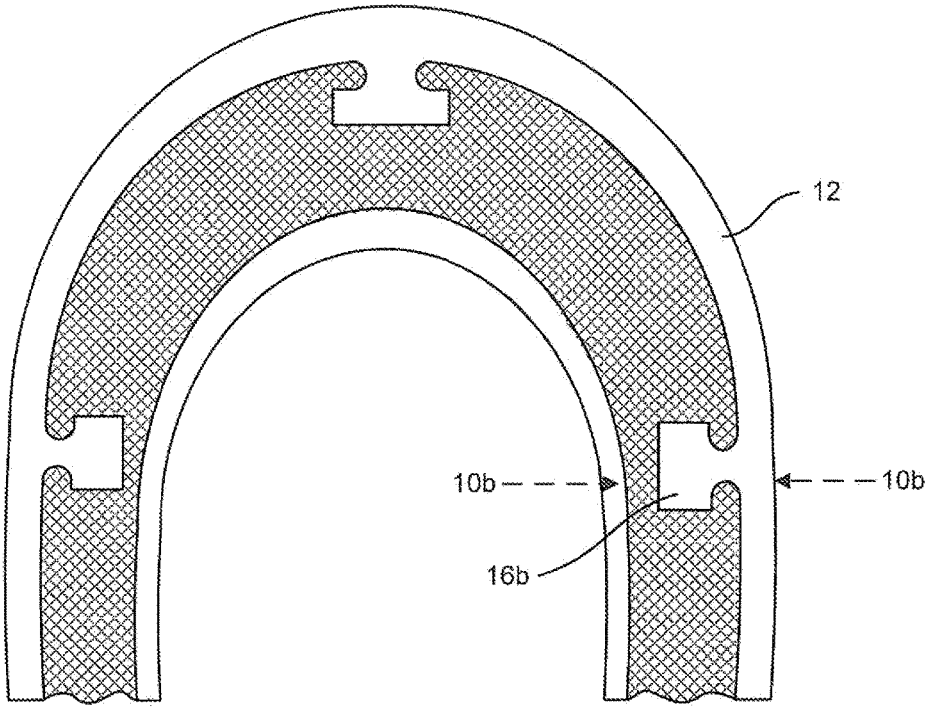
FIG. 10 shows an embodiment of a mouth guard in which the stops are connected to the facial wall.

Preferably the stops 16 are separate from the facial wall 12 and lingual wall 38 with gaps 17 and 39, respectively, there between. Thus, as shown in FIG. 1, stop 16*a* and the facial and lingual walls 12, 38 define gaps 17*a* and 39*a*. In an alternative configuration, particularly suitable if the tray 14 is not integrally formed with the walls 12, 38, the stops 16 could alternatively be formed as extensions of the facial wall 12 and/or lingual wall 38. This configuration would reduce the number of separate components in the mouth guard and to make it easier to place the stops. FIG. 10 shows a configuration where the stops 16 are attached to the facial wall 12 by a bridge 52. Preferably, the bridge is lower than the height of the stop. It can also be narrower than the stop as shown in the figures. The stops can also be connected to an inner lingual wall 38 in addition to or alternatively to being connected to the facial wall.

Figure 3A:
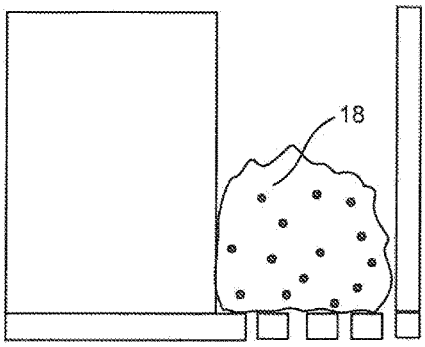
FIGS. 3A/B through 5A/B show the various stages of the application of impression material to the mouth guard of FIG. 1.
Figure 3B:
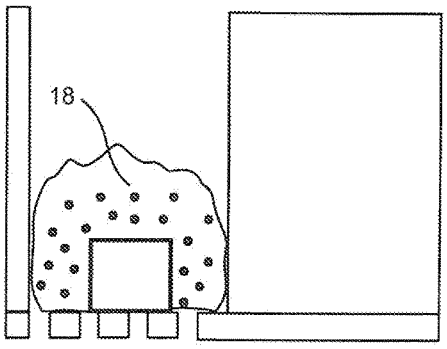

To customize the mouth guard for use by a particular individual, a layer or bead of uncured elastomeric dental impression material 18 is applied to the top of the tray 14. The impression material may be a polyvinyl or silicon rubber composition, or other impression materials known to those of skill in the art. Preferably, sufficient impression material is applied to substantially cover the tray 14 and the stops 16. FIGS. 3A and 3B show impression material 18 applied in this manner.

Figure 4A:
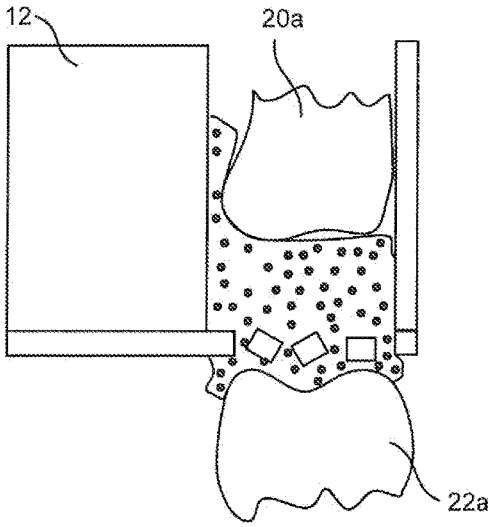
Figure 4B:
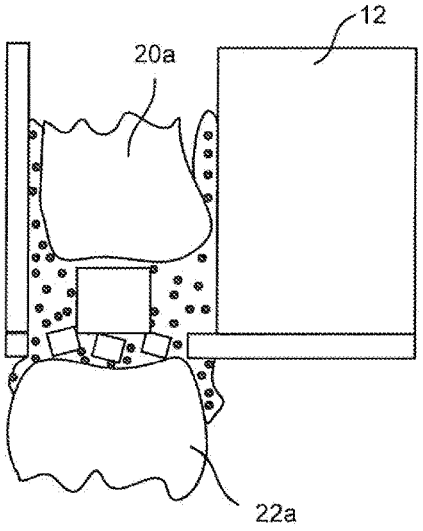

After the impression material 18 is applied to the tray, and as shown in FIGS. 4A and 4B, the mouth guard 10 is placed into the user's mouth, and the user bites down on it. The biting pressure applied by the wearer's upper teeth 20*a*, 20*b* and lower teeth 22*a*, 22*b* deforms the uncured impression material so that it takes an impression of the contours of the user's teeth. The stops 16 prevent the user from closing their mouth too tightly and preserves a layer of impression material 18 of about at least the height of the stops between the upper and lower teeth and above the areas of the tray 14.

The tray 14 is sufficiently flexible to take an impression of the lower teeth 22*a*, 22*b* as the user's mouth is closed. As shown in FIGS. 4A and 4B, when the user bites, the tray 14 flexes and generally follows the contours of the biting surfaces of the user's lower teeth 22*a*, 22*b*. In addition, preferably there are openings, such as holes or vias, in the tray 14 sufficiently large so that uncured impression material placed on the top surface of the tray 14 flows into the holes when the biting pressure is applied so that the impression material 18, when cured, is securely affixed to the tray. Most preferably, the holes are large enough so that the impression material 18 can flow through the tray 14 to take an impression of the lower teeth.

Figure 5A:
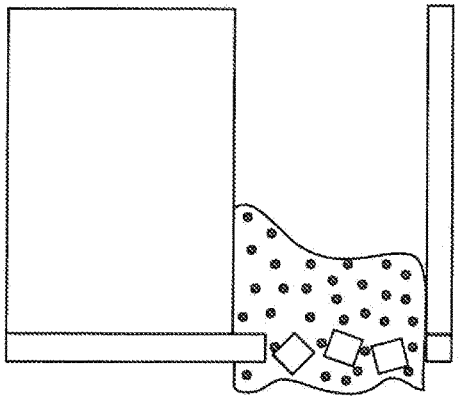
Figure 5B:
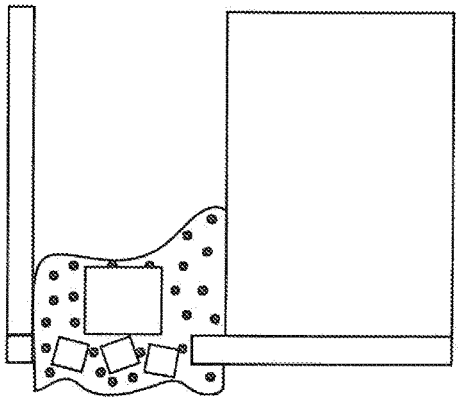

After the impression material 18 has cured sufficiently to generally retain its shape, the mouth guard 10 can be removed from the user's mouth. As shown in FIGS. 5A and 5B, the result is a mouth guard that has been customized to the user's mouth and in which a minimum thickness of impression material has been preserved the top surface of the tray by the action of the stops. The mouth guard can be fitted quickly and on-demand without boiling or other heat treatments at sporting events where mouth guards may be required.

There are a variety of ways in which the impression material 18 can be provided for use. In one configuration, the mouth guard 10 is provided as part of a custom mouth guard kit in which a volume of uncured impression material 18 sufficient for use with at least one mouth guard as disclosed herein is included.

Various types of conventional elastomeric impression materials known to those of skill in the art can be used. In one embodiment, the impression material is a 2-part material, such as polyvinyl siloxane, in which each component comes in the form of a soft putty. The user would simply mix the two putties together, apply them to the mouth guard, and take the impression. The set time of conventional polyvinyl siloxane is about three to five minutes. Preferably, a no-mix or pre-mixed monophase impression material is used. Conventional monophase impression materials such as Genie™ VPS impression material from Sultan Healthcare and Reprosil® VPS impression material from Dentsply.

In a particular embodiment, the impression material can be pre-mixed and of a type that will cure when exposed to air or light, such as visible or ultraviolet light. This impression material would be provided within an airtight and/or light-tight or other suitable packaging to prevent the impression material 18 from curing before its packaging is opened. For example, the impression material can be provided in tube from which it can be squeezed onto the tray. In another embodiment, a roll of impression material tape can be provided that can be applied and pressed onto the tray. In a further embodiment, a block of impression material pre-shaped to place into the tray can be provided.

Figure 6A:
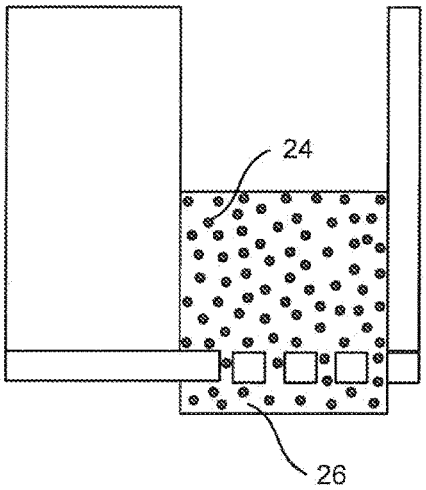
FIGS. 6A and 6B show an alternative embodiment with pre-applied impression material.
Figure 6B:
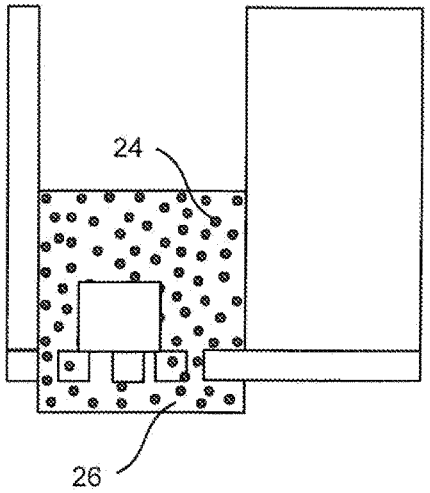

In a further alternative embodiment, shown in FIGS. 6A and 6B, a layer 24 of impression material is pre-applied to the top of the tray 14 of mouth guard 10. Preferably a layer 26 is also pre-applied to the bottom of the tray 14. The pre-applied impression material can also pass through the vias 15 in the tray 14 to help the top and bottom layers 24, 26 of impression material remain attached. In this configuration the utility of the vias to allow material to flow through from the top to the bottom of the tray as an impression is being taken is reduced since impression material is already present on the bottom of the tray. As such the number of vias can be reduced (or even eliminated). The mouth guard 10 with pre-applied impression material can then be placed in a sealed package, such as a plastic or foil packet with a peelable lid. When a new mouth guard is needed, the user need only open the package, apply the impression material to the tray (if not already pre-applied), bite down on the mouth guard to create the impression, and wait a short period of time for the impression material to cure.

The mouth guard kit also preferably includes an appropriately sized plastic case that can be impregnated with a disinfectant, such as Listerine™ or other conventional disinfectants such as chlorhexidine. The case can be provided separately from the mouth guard and impression material or form part of the packaging for the mouth guard kit with the mouth guard (and impression material if pre-applied) contained therein.

For a mouth guard to provide protection from side impacts, the mouth guard should not be too thin along the sides. It can be appreciated that when a user is making a tooth impression in the mouth guard 10, the user might position the mouth guard in then mouth so that the facial surfaces of some of the teeth are immediately adjacent the inner surface 12*c* of the facial wall 12. The result is that the only protection from side impacts provided in this area is by the facial wall itself. To provide adequate protection, the facial wall itself may need to be relatively thick. In addition, the lack of impression material may compromise the fit of the mouth guard in this area.

Figure 7:
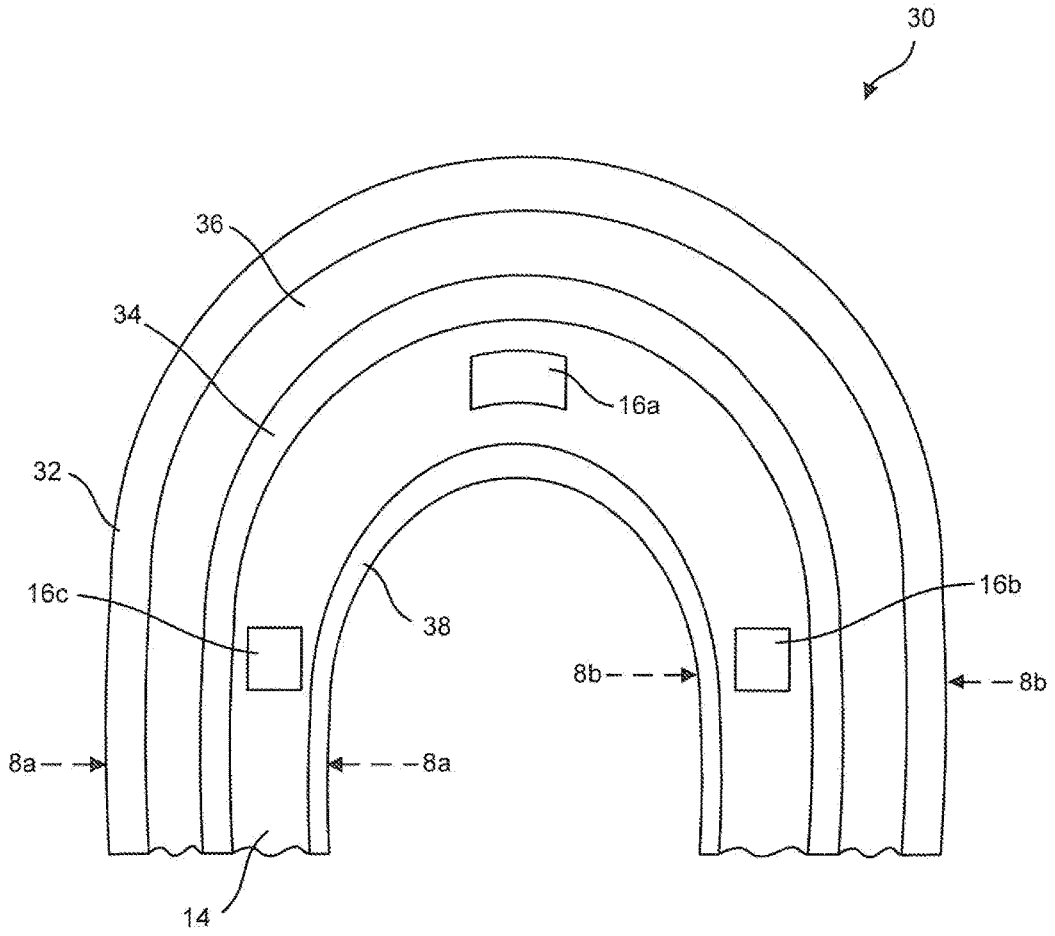
FIG. 7 shows an alternative embodiment of a mouth guard according to aspects of the invention.
Figure 8A:
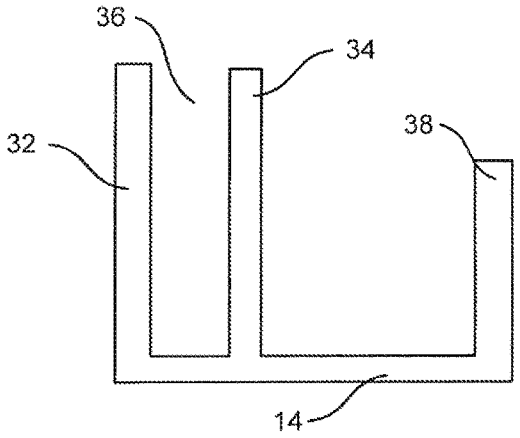
FIGS. 8A and 8B show cross-sectional views along the lines 8*a*-8*a* and 8*b*-8*b* FIG. 7.
Figure 8B:
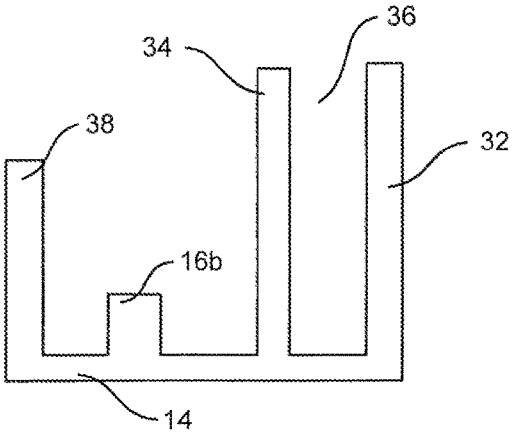
Figure 9A:
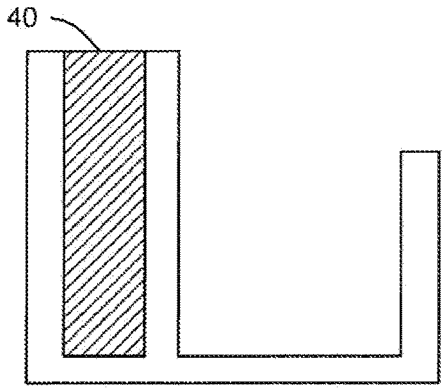
FIGS. 9A-9B show the embodiment of FIGS. 8A and 8B with impact material therein.
Figure 9B:
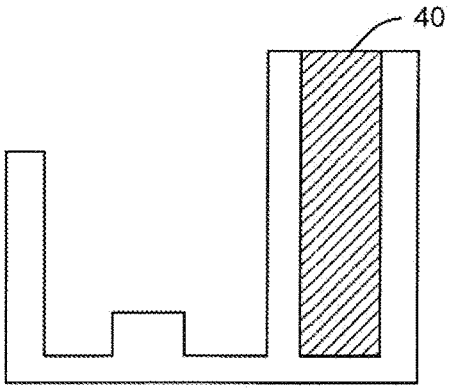

According to a further aspect of the invention, and as shown in FIG. 7 and FIGS. 8A and 8B, the facial wall 12 is comprised of an outer wall 32 and an inner wall 34 with a gap 36 in between them. The use of this double wall allows the material forming the facial wall to remain thin while ensuring that there is a greater distance between the outside of the mouth guard and the user's teeth in order to provide additional protection from side impacts. The gap 36 between the inner and outer walls 32, 34 is preferably between 3.5 and 5 mm and preferably. As shown in FIGS. 9A and 9B, the gap 36 preferably is filled with an impact absorbing material 40.

In one configuration, the impact absorbing material 40 is same material as the impression material 18 and can be applied by the user at the same time as uncured impression material is applied to the tray 14 or pre-applied within the gap 36. This would allow the facial wall 12 of the mouth guard 10 to mold somewhat to the specific shape of the user's upper dental arch. Alternatively, a different type of impact material 40 can be placed in the gap 36.

In a further alternative embodiment, tops and ends of the outer and inner walls 32, 34 can be connected to each other and sealed during manufacturing to form a gas-filled pneumatic cushion.

What is claimed is:

1. A custom mouth guard kit comprising:

(a) a mouth guard base comprising:

a generally U-shaped facial wall having a height between a top and a bottom of the facial wall and a width between an interior and exterior surface of the facial wall, said facial wall sized to cover facial surfaces of at least some of the person's upper teeth when the mouth guard is worn, the facial wall comprising an outer wall and an inner wall having a facial wall gap therebetween, the outer wall defining the exterior surface of the facial wall, the inner wall defining the interior surface of the facial wall;

a generally U-shaped lingual wall positioned within an interior space defined by the facial wall, the lingual wall having a lingual wall height between a top and a bottom of the lingual wall and a lingual wall width between an interior and exterior surface of the lingual wall, the exterior surface of the lingual wall and the interior surface of the facial wall defining a tooth gap therebetween having a width sufficient to receive the person's upper teeth when the mouth guard is worn;

a generally flat, thin, flexible tray joining the facial and lingual walls, the tray having a thickness between a top and a bottom surface and being generally perpendicular to the interior surfaces of the facial and lingual walls; and a plurality of stops extending upward from the top surface of said tray; and (b) a volume of uncured elastomeric impression material sufficient to cover at least a substantial portion of the top surface of the tray to a depth of at least about the height of said stops.

2. The kit of claim 1, wherein the tray has a plurality of openings extending between the top and bottom surfaces of the tray, the openings sized to permit uncured impression material on the top surface of the tray to flow through to the bottom surface of the tray when the mouth guard is worn and biting pressure is applied.

3. The kit of claim 2, wherein the tray comprises a mesh material.

4. The kit of claim 1, wherein the facial wall, lingual wall, tray and stops are integrally formed with each other.

5. The kit of claim 1, wherein the facial wall is sized to cover facial surfaces of at least the person's upper incisors, upper canines, and upper pre-molars when the mouthguard is worn; and wherein the plurality of stops comprises at least first, second, and third stops; the stops being positioned on the tray such that, when the mouth guard is worn, said first stop will be generally adjacent a biting surface of upper central incisors of said person's upper teeth and said second and third stops will be generally adjacent a biting surface of respective left and right upper molars or pre-molars of said person's upper teeth.

6. The kit of claim 1, wherein said stops have a height of at least twice the thickness of the tray.

7. The kit of claim 1, further comprising a respective bridge connecting each said stop to at least one of the facial wall and the lingual wall.

8. The kit of claim 1, wherein the volume of uncured impression material is pre-mixed and cures when exposed to at least one of air and light;

the kit further comprising packaging containing at least the volume of uncured impression material and configured to prevent the volume of uncured impression material from curing before the packaging is opened.

9. The kit of claim 8, wherein the volume of uncured impression material comprises a layer covering a substantial portion of the top surface of the tray, the packaging further containing the mouth guard base.

10. The kit of claim 9, wherein the volume of uncured impression material further comprises a layer covering at least a portion of the bottom surface of the tray.

11. The kit of claim 1, further comprising a plastic case for storing the mouth guard.

12. The kit of claim 11, wherein the case is impregnated with a disinfectant.

13. A custom mouth guard kit comprising:

a mouth guard base comprising:

a generally U-shaped facial wall having a height between a top and a bottom of the facial wall and a width between an interior and exterior surface of the facial wall, said facial wall sized to cover facial surfaces of at least some of the person's upper teeth when the mouth guard is worn, the facial wall comprising an outer wall and an inner wall defining a facial wall gap therebetween, the outer wall defining the exterior surface of the facial wall, the inner wall defining the interior surface of the facial wall;

a generally U-shaped lingual wall positioned within an interior space defined by the facial wall, the lingual wall having a lingual wall height between a top and a bottom of the lingual wall and a lingual wall width between an interior and exterior surface of the lingual wall, the exterior surface of the lingual wall and the interior surface of the facial wall defining a tooth gap therebetween having a width sufficient to receive the person's upper teeth when the mouth guard is worn;

a generally flat, thin, flexible tray joining the facial and lingual walls, the tray having a thickness between a top and a bottom surface and being generally perpendicular to the interior surfaces of the facial and lingual walls;

a plurality of stops extending upward from the top surface of said tray, the plurality of stops comprising at least first, second, and third stops; the stops being positioned on the tray such that, when the mouth guard is worn, said first stop will be generally adjacent a biting surface of upper central incisors of said person's upper teeth and said second and third stops will be generally adjacent a biting surface of respective left and right upper molars or pre-molars of said person's upper teeth.

14. The kit of claim 13, further comprising a volume of uncured elastomeric impression material sufficient to cover at least a substantial portion of the top surface of the tray to a depth of at least about the height of said stops.

15. A custom mouth guard kit comprising:

(a) a mouth guard base comprising:

a generally U-shaped facial wall having a height between a top and a bottom of the facial wall and a width between an interior and exterior surface of the facial wall, said facial wall sized to cover facial surfaces of at least some of the person's upper teeth when the mouth guard is worn;

a generally U-shaped lingual wall positioned within an interior space defined by the facial wall, the lingual wall having a lingual wall height between a top and a bottom of the lingual wall and a lingual wall width between an interior and exterior surface of the lingual wall, the exterior surface of the lingual wall and the interior surface of the facial wall defining a tooth gap therebetween having a width sufficient to receive the person's upper teeth when the mouth guard is worn;

a generally flat flexible tray joining the facial and lingual walls, the tray having a thickness between a top and a bottom surface and being generally perpendicular to the interior surfaces of the facial and lingual walls; and a plurality of stops extending upward from the top surface of said tray; and (b) a volume of uncured elastomeric impression material sufficient to cover at least a substantial portion of the top surface of the tray to a depth of at least about the height of said stops.

16. The kit of claim 15, wherein the tray has a plurality of openings extending between the top and bottom surfaces of the tray, the openings sized to permit uncured impression material on the top surface of the tray to flow through to the bottom surface of the tray when the mouth guard is worn and biting pressure is applied.

17. The kit of claim 15, wherein the facial wall, lingual wall, tray and stops are integrally formed with each other.

18. The kit of claim 15, wherein the facial wall is sized to cover facial surfaces of at least the person's upper incisors, upper canines, and upper pre-molars when the mouthguard is worn; and wherein the plurality of stops comprises at least first, second, and third stops; the stops being positioned on the tray such that, when the mouth guard is worn, said first stop will be generally adjacent a biting surface of upper central incisors of said person's upper teeth and said second and third stops will be generally adjacent a biting surface of respective left and right upper molars or pre-molars of said person's upper teeth.

19. The kit of claim 15, wherein said stops have a height of at least twice the thickness of the tray.

20. The kit of claim 15, further comprising a respective bridge connecting each said stop to at least one of the facial wall and the lingual wall.

21. The kit of claim 15, wherein the volume of uncured impression material is pre-mixed and cures when exposed to at least one of air and light;

the kit further comprising packaging containing at least the volume of uncured impression material and configured to prevent the volume of uncured impression material from curing before the packaging is opened.

22. The kit of claim 21, wherein the volume of uncured impression material comprises a layer covering a substantial portion of the top surface of the tray, the packaging further containing the mouth guard base.

23. The kit of claim 22, wherein the volume of uncured impression material further comprises a layer covering at least a portion of the bottom surface of the tray.

* * * * *